US012083578B2

(12) United States Patent
Kishigami

(10) Patent No.: US 12,083,578 B2
(45) Date of Patent: Sep. 10, 2024

(54) METHOD FOR PRESS FORMING AND APPARATUS FOR PRESS FORMING AUTOMOTIVE OUTER PANEL

(71) Applicant: JFE Steel Corporation, Tokyo (JP)

(72) Inventor: Yasuhiro Kishigami, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 227 days.

(21) Appl. No.: 17/765,185

(22) PCT Filed: Jul. 8, 2020

(86) PCT No.: PCT/JP2020/026655
§ 371 (c)(1),
(2) Date: Mar. 30, 2022

(87) PCT Pub. No.: WO2021/065139
PCT Pub. Date: Apr. 8, 2021

(65) Prior Publication Data

US 2022/0379364 A1 Dec. 1, 2022

(30) Foreign Application Priority Data

Oct. 2, 2019 (JP) ..... 2019-181982

(51) Int. Cl.
*B21D 53/88* (2006.01)
*B21D 22/10* (2006.01)
(Continued)

(52) U.S. Cl.
CPC ..... *B21D 53/88* (2013.01)

(58) Field of Classification Search
CPC ..... B21D 53/88; B21D 22/10; B21D 22/22; B21D 22/26; B21D 24/08; B21D 24/02; B21D 24/04
See application file for complete search history.

(56) References Cited

U.S. PATENT DOCUMENTS

2009/0038365 A1* 2/2009 Yoshida ..... B21D 22/22 72/389.5
2010/0018280 A1 1/2010 Maeda et al.
(Continued)

FOREIGN PATENT DOCUMENTS

CN 101054003 A 10/2007
CN 102896215 A 1/2013
(Continued)

OTHER PUBLICATIONS

Puresu Seikei Nani Handobukku (Press Molding Difficulty Handbook), 4th Ed., "Chapter 5 Menkeijou Seido Furyou to Seikei Nani Hyouka" with partial translation, 2017, Edition: Japan Sheet Metal Forming Research Group, Nikkan Kogyo Shimbun, Ltd., 7 pages.
(Continued)

*Primary Examiner* — Mohammed S. Alawadi
(74) *Attorney, Agent, or Firm* — Buchanan Ingersoll & Rooney PC

(57) ABSTRACT

A method for press forming an automotive outer panel includes: providing an elastic body to a punch such that the elastic body abuts against a metal sheet away from a portion corresponding to a character line in the metal sheet; abutting a contact surface portion of the protruding elastic body against the metal sheet; and forming the character line with the ridgeline and the valley line by relatively moving the die toward the punch while abutting the contact surface portion against the metal sheet to deform the elastic body such that the elastic body becomes flush with the punch-side forming surface portion at a bottom dead center of forming. A protrusion amount of the elastic body from the punch-side forming surface portion is set such that the elastic body contacts the metal sheet before the ridgeline contacts the metal sheet to cause the metal sheet to become plastically deformed.

12 Claims, 8 Drawing Sheets

(51) Int. Cl.

| | |
|---|---|
| ***B21D 22/22*** | (2006.01) |
| ***B21D 22/26*** | (2006.01) |
| ***B21D 24/02*** | (2006.01) |
| ***B21D 24/04*** | (2006.01) |
| ***B21D 24/08*** | (2006.01) |

(56) References Cited

U.S. PATENT DOCUMENTS

| | | | | |
|---|---|---|---|---|
| 2012/0137749 | A1* | 6/2012 | Park | B21D 24/04 72/460 |
| 2013/0025343 | A1 | 1/2013 | Golovashchenko | |
| 2016/0121384 | A1 | 5/2016 | Sumikawa et al. | |
| 2018/0264535 | A1 | 9/2018 | Otsuka et al. | |

FOREIGN PATENT DOCUMENTS

| | | | |
|---|---|---|---|
| CN | 105307792 | A | 2/2016 |
| CN | 105358269 | A | 2/2016 |
| CN | 105437604 | A | 3/2016 |
| CN | 108025344 | A | 5/2018 |
| EP | 2754509 | A1 | 7/2014 |
| EP | 2998042 | A1 | 3/2016 |
| JP | 6358652 | B2 | 11/1988 |
| JP | 2007326112 | A | 12/2007 |
| JP | 2008100239 | A | 5/2008 |
| JP | 2015199102 | A | 11/2015 |
| JP | 5876786 | B2 | 3/2016 |
| JP | 5959702 | B1 | 8/2016 |
| JP | 2018103249 | A | 7/2018 |
| JP | 2018158351 | A | 10/2018 |
| WO | 2013035520 | A1 | 3/2013 |

OTHER PUBLICATIONS

International Search Report and Written Opinion for International Application No. PCT/JP2020/026655, dated Aug. 4, 2020, 6 pages.

Extended European Search Report for European Application No. 20 871 747.0, dated Oct. 28, 2022, 7 pages.

Korean Office Action for Korean Application No. 10-2022-7012643, dated Jan. 12, 2024 with Concise Statement of Relevance of Office Action, 6 pages.

Chinese Office Action with English Search Report for Chinese Application No. 202080068624.0, dated Mar. 19, 2024. (11 pages).

* cited by examiner

METHOD FOR PRESS FORMING AND APPARATUS FOR PRESS FORMING AUTOMOTIVE OUTER PANEL

CROSS REFERENCE TO RELATED APPLICATIONS

This is the U.S. National Phase application of PCT/JP2020/026655, filed Jul. 8, 2020 which claims priority to Japanese Patent Application No. 2019-181982, filed Oct. 2, 2019, the disclosures of these applications being incorporated herein by reference in their entireties for all purposes.

FIELD OF THE INVENTION

The present invention relates to a method for press forming and an apparatus for press forming an automotive outer panel, in which press forming an automotive outer panel formed with a character line is press formed. In the present invention, a metal sheet refers to a hot-rolled sheet, a cold-rolled sheet, and a surface treated steel sheet in which a steel sheet is subjected to surface treatment (electro galvanization, hot-dip galvanization, organic coating treatment, or the like) as well as a sheet formed of various kinds of metals such as stainless steel, aluminum, and magnesium.

BACKGROUND OF THE INVENTION

Automotive outer panels for use in door outers, front fenders, rear fenders, and the like of automobiles are provided with a character line on their outer surfaces in many cases from the viewpoint of improving the designability and the tension rigidity of automobiles. The character line is normally provided by pressing a metal sheet (blank) against a ridgeline provided in a punch of a tool of press forming and sandwiching the metal sheet with a valley line of a die. In recent years in particular, to further improve the designability of automobiles, a sharp character line (that is, having a large curvature (having a small curvature radius) of the ridgeline) has been demanded to be provided.

By the way, in this kind of press forming, when imbalance in tension occurring in the metal sheet during forming occurs, the metal sheet slides in a direction with high tension, the ridgeline of the punch contacts a portion other than a portion to be provided with the character line, and a linear pattern may occur. Such a linear pattern remains even after coating and forms a faulty appearance called a skid line of outer panels. This skid line is particularly conspicuous when press forming is performed in order to provide a sharp character line using a punch in which the tip of the ridgeline is formed by an arc having a small sectional radius and is thus a factor to hinder improvement in the designability of automobiles.

Some techniques providing the character line with the occurrence of such a linear pattern inhibited have so far been developed. Patent Literature 1 discloses a method for press forming providing an auxiliary cross-sectional shape in forming of a design recess in a die and a blank holder to hold the periphery of the blank to subject a central part of the blank to bending deformation in advance so as to follow a forming surface of a punch and then performing forming by the punch to form a design surface, for example. Patent Literature 2 discloses a method in which suction ports are formed in a press surface on which a linear protrusion forming a character line is provided, a metal sheet is suctioned to the press surface by a suction apparatus performing suction from the suction ports via gas channels to perform press forming, whereby the movement of the metal sheet is inhibited to prevent the skid line. Patent Literature 3 discloses a technique subjecting a blank to primary forming by a punch angle and a cushion pad and then performing deep drawing and stretch forming while lowering a punch to prevent the skid line occurring in a portion of a metal sheet with which the punch angle has made contact. Patent Literature 4 discloses a technique in which, in producing a press formed product having a ridgeline, a first press forming process forming a pre-forming shape and a second forming process further forming the pre-forming shape eliminate the skid line to obtain a high-quality press formed product. Patent Literature 5 discloses a technique making a punch ridgeline an elastic body to relax bending in an early forming stage.

PATENT LITERATURE

Patent Literature 1: U.S. Pat. No. 5,876,786

Patent Literature 2: Japanese Patent Application Laid-open No. 2015-199102

Patent Literature 3: Japanese Examined Patent Application Publication No. S63-58652

Patent Literature 4: U.S. Pat. No. 5,959,702

Patent Literature 5: Japanese Patent Application Laid-open No. 2018-103249

SUMMARY OF THE INVENTION

However, the techniques disclosed in Patent Literature 1 to Patent Literature 5 have the following problems. In the technique disclosed in Patent Literature 1, deformation by the die and the blank holder provided with the auxiliary cross-sectional shape in forming does not have restraint by the punch, only blank both ends corresponding to the design recess can be restrained, and thus the bending deformation is limited to a linear shape. In the technique disclosed in Patent Literature 2, the suction apparatus, which is not used in normal press forming, is required, and in addition, there is a concern that the shape of the suction ports is transferred to the surface of a formed product. In the technique disclosed in Patent Literature 3, a final product shape is partially formed midway during forming, and thus there is a concern that surface distortion may occur between the final product shape and a portion uncompleted to be formed. In the technique disclosed in Patent Literature 4, the tool of press forming for forming the pre-forming shape and the tool of press forming for forming a target shape are different from each other, and the number of steps for replacement of the tool of press forming and the like increases. In the technique disclosed in Patent Literature 5, the convex side of the ridgeline is formed by the elastic body, and thus there is a concern that the ridgeline is not formed as the target shape.

Aspects of the present invention have been made in order to solve the above problems, and an object thereof is to provide a method for press forming and an apparatus for press forming an automotive outer panel forming a target character line with a skid line prevented without increasing the number of man-hours for press forming.

A method for press forming an automotive outer panel according to aspects of the present invention uses a punch having a ridgeline, a die having a valley line facing the punch, and a blank holder facing ends of the die to press form a metal sheet into the automotive outer panel having a character line formed by the ridgeline and the valley line and panel surface portions continuous with both sides of the character line, and includes: providing an elastic body to the punch such that the elastic body abuts against the metal sheet away from a portion corresponding to the character line in the metal sheet, the elastic body forming one of the panel surface portions and protruding toward the die beyond a punch-side forming surface portion; an elastic body abutting step of abutting a contact surface portion of the protruding elastic body against the metal sheet by relatively moving the die toward the punch with both ends of the metal sheet held between the die and the blank holder; and a character line forming step of forming the character line with the ridgeline and the valley line by further relatively moving the die toward the punch while abutting the contact surface portion of the protruding elastic body against the metal sheet to deform the elastic body such that the elastic body becomes flush with the punch-side forming surface portion at a bottom dead center of forming, wherein a protrusion amount of the elastic body from the punch-side forming surface portion is set such that the elastic body contacts the metal sheet before the ridgeline of the punch contacts the metal sheet to cause the metal sheet to become plastically deformed.

In the above-described method for press forming an automotive outer panel, the elastic body is provided in the punch via a movable device movable along a press forming direction and configured to press the elastic body toward the die to support the elastic body.

In the above-described method for press forming an automotive outer panel, the elastic body contacts a portion on a side having low tension in a press forming process among portions on both sides of a portion where the ridgeline of the punch contacts in the metal sheet.

In the above-described method for press forming an automotive outer panel, the elastic body contacts a portion on a side having higher tension in a press forming process among portions on both sides of a portion where the ridgeline of the punch contacts in the metal sheet.

An apparatus for press forming an automotive outer panel according to aspects of the present invention includes: a punch having a ridgeline; a die having a valley line facing the punch; and a blank holder facing ends of the die, wherein the apparatus is configured to press form a metal sheet into an automotive outer panel having a character line formed by the ridgeline and the valley line and panel surface portions continuous with both sides of the character line, the punch includes punch-side forming surface portions forming the respective panel surface portions on both sides, either of the punch-side forming surface portions includes an elastic body protruding toward the die beyond one of the punch-side forming surface portions so as to abut against the metal sheet away from a portion of the metal sheet where the ridgeline of the punch contacts, the elastic body being deformed until a contact surface portion in contact with the metal sheet becomes flush with the one of the punch-side forming surface portions, and a protrusion amount of the elastic body from the one of the punch-side forming surface portions is set such that the elastic body contacts the metal sheet before the ridgeline of the punch contacts the metal sheet to cause the metal sheet to become plastically deformed.

In the above-described apparatus for press forming an automotive outer panel, the elastic body is provided in the punch via a movable device movable along a press forming direction and configured to press the elastic body toward the die to support the elastic body.

In the above-described apparatus for press forming an automotive outer panel, the elastic body is provided in the one of the punch-side forming surface portions so as to contact a portion on a side having low tension in a press forming process among portions on both sides of a portion where the ridgeline of the punch contacts in the metal sheet.

In the above-described apparatus for press forming an automotive outer panel, the elastic body is provided in the one of the punch-side forming surface portions so as to contact a portion on a side having higher tension in a press forming process among portions on both sides of a portion where the ridgeline of the punch contacts in the metal sheet.

According to aspects of the present invention, press forming is performed while causing the elastic body to protrude from the punch-side forming surface portion to be made in contact with the metal sheet, whereby the portion of the metal sheet with which the ridgeline of the punch and the contact surface portion of the elastic body make contact is gradually subjected to bending deformation to be made a gentle shape, and the character line is formed at the bottom dead center of forming, whereby the occurrence of an initial bending fold of the metal sheet by the ridgeline of the punch can be prevented, and an automotive outer panel formed with the character line can be press formed with a skid line reduced.

DETAILED DESCRIPTION OF EMBODIMENTS OF THE INVENTION

Prior to describing a method for press forming and an apparatus for press forming an automotive outer panel according to first and second embodiments of the present invention, the following describes a skid line occurring in the press forming of an automotive outer panel having a character line.

<Reason why Skid Line Occurs>

Figure 7:
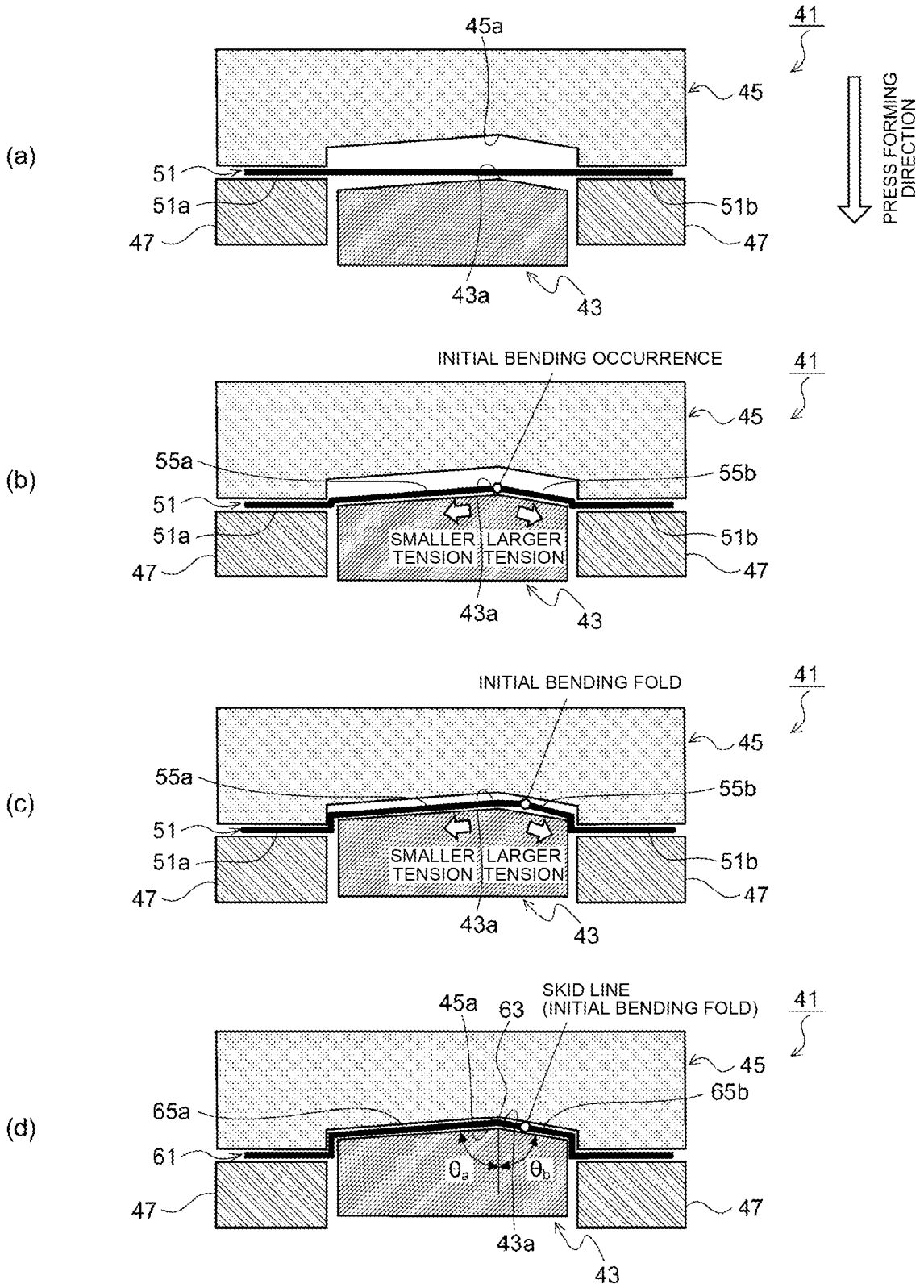
FIG. 7 is a diagram illustrating a conventional apparatus for press forming and a conventional method for press forming an automotive outer panel and a skid line occurring in a press forming process.

An automotive outer panel 61 as an object according to aspects of the present invention has a character line 63 and panel surface portions 65*a* and 65*b* continuous with both sides thereof as illustrated in FIG. 7(*d*) and is deeply drawn as follows using an apparatus 41 for press forming including a punch 43 having a ridgeline 43*a* extending in a front-and-back direction of the paper surface, a die 45 having a valley line 45*a* extending in the front-and-back direction of the paper surface, and a blank holder 47 facing both ends of the die 45.

First, as illustrated in FIG. 7(*a*), ends 51*a* and 51*b* of a metal sheet 51 are held between the die 45 and the blank holder 47. While they are held, as illustrated in FIGS. 7(*b*) to 7(*d*), the die 45 and the blank holder 47 are relatively moved toward the punch 43 up to a bottom dead center of forming to press form the automotive outer panel 61 formed with the character line 63 by the ridgeline 43*a* of the punch 43 and the valley line 45*a* of the die 45.

When the die 45 is relatively moved toward the punch 43 in this press forming process, first, the ridgeline 43*a* of the punch 43 contacts the metal sheet 51, and initial bending occurs in the metal sheet 51 (FIG. 7(*b*)). During the process in which deep drawing proceeds by the die 45 and the punch 43, tensions occur in the metal sheet 51 in directions directed toward the end 51*a* and the end 51*b* with an initial bending fold as a boundary (FIGS. 7(*b*) and 7(*c*)).

These tensions occurring in the metal sheet 51 differ from each other with the initial bending fold as a boundary by differences in the distances from the initial bending fold to the end 51*a* and the end 51*b*, the angles of the panel surface portion 65*a* and the panel surface portion 65*b* (FIG. 7(*d*)) with respect to a press forming direction, and forming direction depths from the ridgeline 43*a* to the end 51*a* and the end 51*b* caused by these.

When the acute angle with the panel surface portion 65*a* is ea, and the acute angle with the panel surface portion 65*b* is θb based on the line drawn from the ridgeline 43*a* of the punch 43 in the direction opposite to the press forming direction, for example, when the angle θb of the panel surface portion 65*b* with respect to the press forming direction is smaller than the angle θa of the panel surface portion 65*a* as in the press forming of the automotive outer panel 61 (refer to FIG. 7(*d*)), in the press forming process, the tension occurring on the end 51*b* side (a portion 55*b*) is larger than the tension occurring on the end 51*a* side (a portion 55*a*) of the metal sheet 51 (FIGS. 7(*b*) and 7(*c*)).

When a tension difference thus occurs with the initial bending fold as a boundary, slipping toward the side with high tension occurs in the metal sheet 51, and the initial bending fold slips toward the end 51*b* with high tension (FIG. 7(*c*)). The initial bending fold is crushed by the punch 43 and the die 45 at the bottom dead center of forming, and a linear pattern, that is, the skid line occurs (FIG. 7(*d*)).

Thus, the skid line in the automotive outer panel 61 formed with the character line 63 is caused by the imbalance in the tensions occurring in the metal sheet 51 in its deep drawing process. Examples of the factor causing the imbalance in the tensions include the difference in the forming depths at both ends 51*a* and 51*b* of the metal sheet 51 caused by the differences in the distances and the angles from the portion where the ridgeline 43*a* of the punch 43 contacts to the end 51*a* and the end 51*b* of the metal sheet 51 as described above.

That is to say, when the forming depths at both ends 51*a* and 51*b* of the metal sheet 51 are different from each other, the tension occurring on the end 51*b* side with a larger forming depth is larger in the deep drawing process, and the skid line occurs by a tension difference with the side with a smaller forming depth.

The following describes the method for press forming and the apparatus for press forming an automotive outer part according to the first embodiment and the second embodiment of the present invention. In the following description, portions having the same function are denoted by the same symbol as that of the aforementioned description to avoid a duplicate description.

First Embodiment

<Apparatus for Press Forming>

As exemplified in FIG. 1 and FIG. 2, this apparatus 1 for press forming an automotive outer part according to the first embodiment (hereinafter, referred to simply as an "apparatus 1 for press forming") press forms the metal sheet 51 into the automotive outer panel 61 having the character line 63 and the panel surface portions 65*a* and 65*b* continuous with both sides thereof (FIG. 2(*d*)) and includes a punch 3, a die 5, a blank holder 7, and an elastic body 9.

Figure 2:
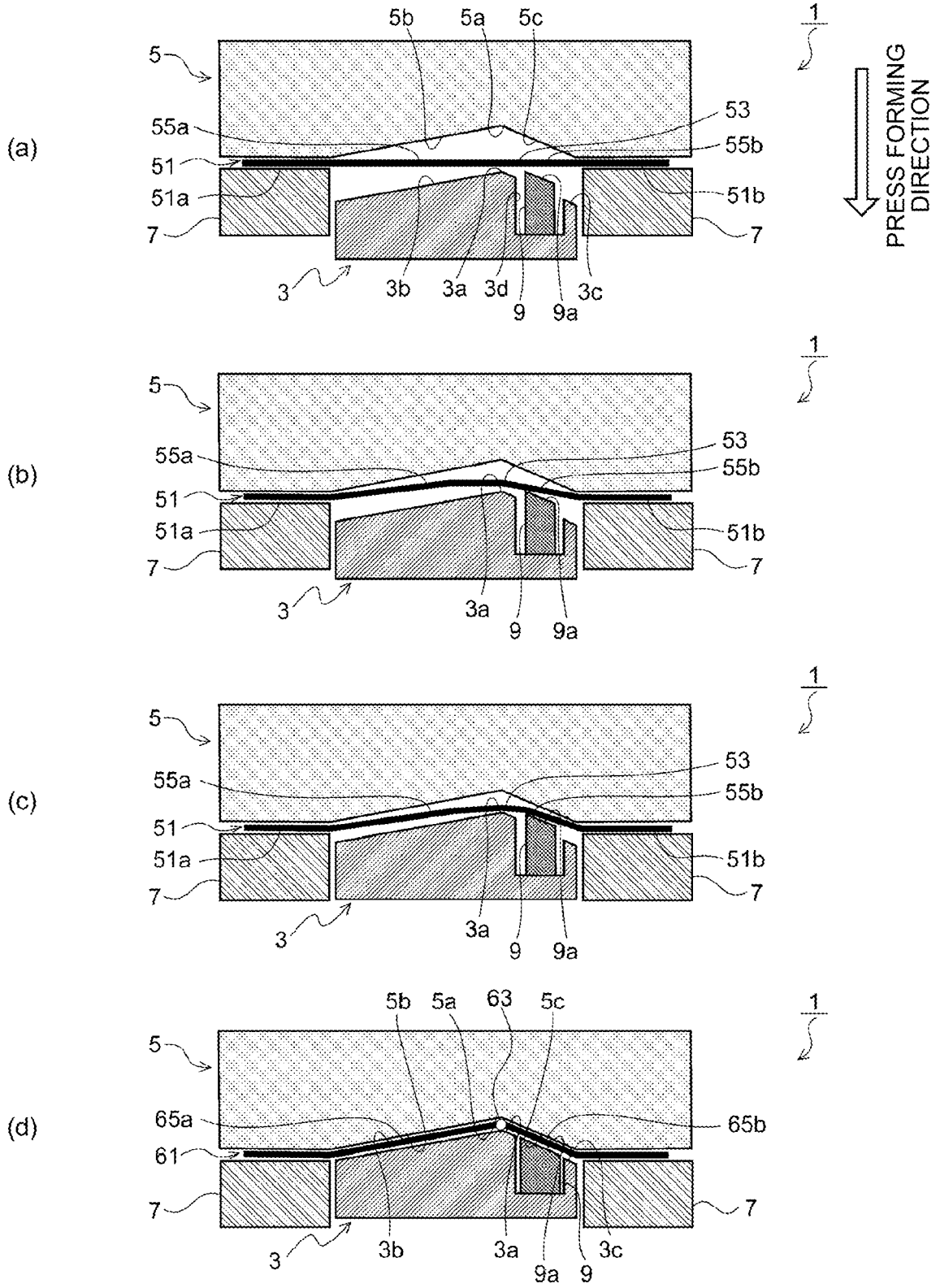
FIG. 2 is a diagram illustrating a method for press forming an automotive outer panel according to the first embodiment of the present invention.

As illustrated in FIG. 7 described above, in the automotive outer panel 61 to be formed in the first embodiment (FIG. 2(*d*)), it is assumed that the angle θb of the panel surface portion 65*b* is smaller than the angle θa of the panel surface portion 65*a* with respect to the press forming direction, and in the press forming process, the tension occurring on the end 51*b* side (the portion 55*b*) is larger than the tension occurring on the end 51*a* side (the portion 55*a*) with a portion where the ridgeline 3*a* of the punch 3 contacts as a boundary (FIG. 2).

Figure 1:
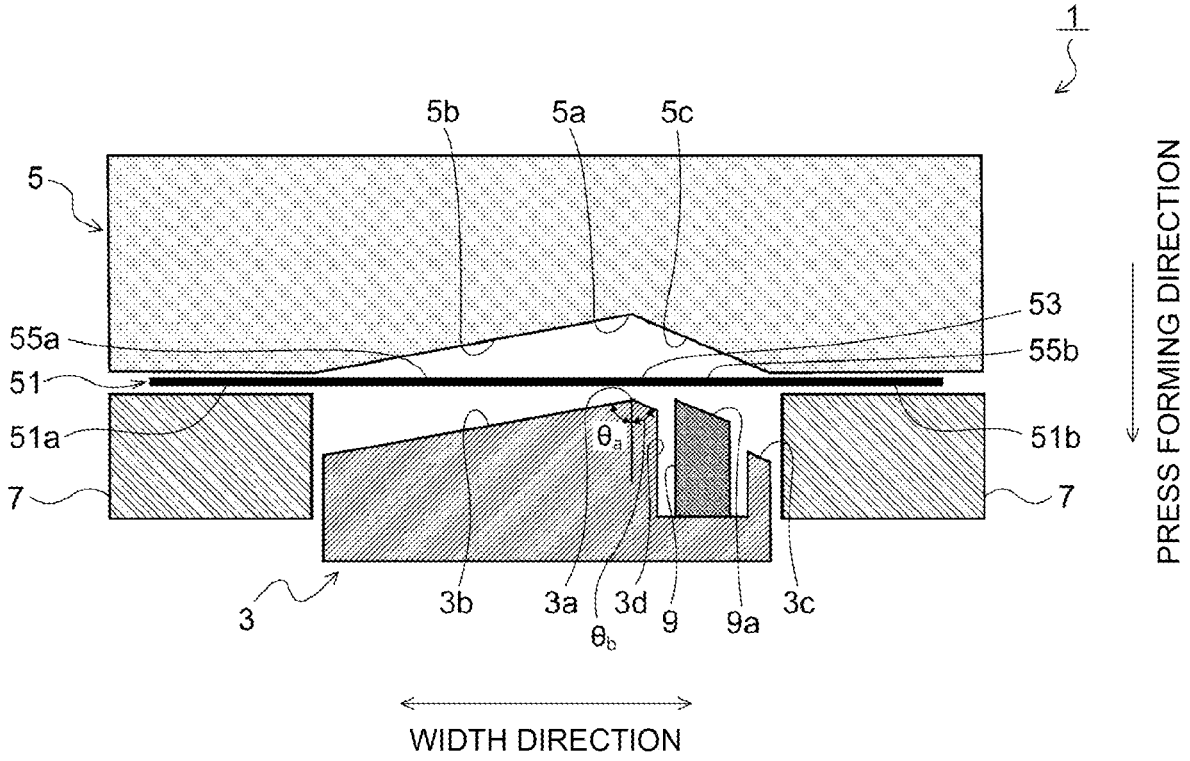
FIG. 1 is a diagram illustrating an apparatus for press forming an automotive outer panel according to a first embodiment of the present invention.

As illustrated in FIG. 1 and FIG. 2, the punch 3 has the ridgeline 3*a*, punch-side forming surface portions 3*b* and 3*c* positioned on both side across the ridgeline 3*a*, and a groove 3*d*. The ridgeline 3*a* forms the character line 63 (FIG. 2(*d*)). The punch-side forming surface portions 3*b* and 3*c* form the panel surface portions 65*a* and 65*b*, respectively (FIG. 2(*d*)). The groove 3*d* is formed in a concave shape in the punch-side forming surface portion 3*c* and is provided with the elastic body 9. The boundary of the groove 3*d* closer to the ridgeline 3*a* may be separated from the ridgeline 3*a* by 10% or more of the length of the punch side forming surface 3*c*.

The die 5 has a valley line 5*a* and die-side forming surface portions 5*b* and 5*c* continuous with both sides across the valley line 5*a*. The valley line 5*a* forms the character line 63 (FIG. 2(*d*)) in cooperation with the ridgeline 3*a* of the punch 3. The die-side forming surface portions 5*b* and 5*c* form the panel surface portions 65*a* and 65*b*, respectively (FIG. 2(*d*)), in cooperation with the punch-side forming surface portions 3*b* and 3*c*, respectively.

The punch-side forming surface portion 3*b* and the die-side forming surface portion 5*b* form the portion 55*a* in which the tension acting on the metal sheet 51 in the press forming process is smaller into the panel surface portion 65*a*. On the other hand, the punch-side forming surface portion 3*c* and the die-side forming surface portion 5*c* form the portion 55*b* in which the tension acting on the metal sheet 51 in the press forming process is larger into the panel surface portion 65*b*.

The blank holder 7 is placed facing both ends of the die 5 and holds the ends 51*a* and 51*b* of the metal sheet 51 in cooperation with the die 5.

The elastic body 9 is provided in the groove 3*d* of the punch 3 so as to be capable of contacting a position separate from a portion 53 corresponding to the character line 63 in the metal sheet 51 along the portion 53 and is mounted on the bottom of the groove 3*d* so as to protrude toward the die 5 beyond the punch-side forming surface portion 3*c* and to be capable of becoming deformed (contracting in the press forming direction) until a contact surface portion 9*a* in contact with the metal sheet 51 becomes flush with the punch-side forming surface portion 3*c*.

A protrusion amount of the elastic body 9 from the punch-side forming surface portion 3*c* is set such that when the die 5 is relatively moved toward the punch 3, the contact surface portion 9*a* contacts the metal sheet 51 before the portion of the metal sheet 51 with which the ridgeline 3*a* of the punch 3 has made contact becomes plastically deformed.

The elastic body 9 protrudes beyond the punch-side forming surface portion 3*c* to make the bent shape of the metal sheet 51 by the ridgeline 3*a* gentle while the elastic body 9 is in contact with the metal sheet 51 up to the bottom dead center of forming. And the elastic body 9 may have a hardness and a shape being capable of becoming deformed along a shape of a tool of press forming (the shape of the punch-side forming surface portion 3*c*) at the bottom dead center of forming. Examples of a specific material of such an elastic body 9 include a rubber material and a urethane material having a Shore hardness of 40 to 100 HS.

<Method for Press Forming>

As to the method for press forming the automotive outer panel 61 according to the first embodiment, the following describes a case in which the automotive outer panel 61 formed with the character line 63 is press formed as illustrated in FIG. 2 using the apparatus 1 for press forming exemplified in FIG. 1.

The method for press forming an automotive outer panel according to the first embodiment uses the apparatus 1 for press forming including the punch 3, the die 5, the blank holder 7, and the elastic body 9 illustrated in FIG. 1 to press form the automotive outer panel 61 having the character line 63 and the panel surface portions 65*a* and 65*b* continuous with both sides thereof as illustrated in FIG. 2 and includes an elastic body contact step relatively moving the die 5 toward the punch 3 to make the elastic body 9 in contact with the metal sheet 51 and a character line forming step crushing the elastic body 9 at the bottom dead center of forming to form the character line 63 by the ridgeline 3*a* of the punch 3 and the valley line 5*a* of the die 5.

As described above, the elastic body 9 is provided in the groove 3*d* formed in the punch-side forming surface portion 3*c* and is mounted on the bottom of the groove 3*d* so as to protrude toward the die 5 beyond the punch-side forming surface portion 3*c* so as to be capable of contacting the position separate from the portion 53 corresponding to the character line 63 in the metal sheet 51 and to be capable of becoming deformed (contracting in the press forming direction) until the contact surface portion 9*a* in contact with the metal sheet 51 becomes flush with the punch-side forming surface portion 3*c*. The following describes the elastic body contact step and the character line forming step.

<<Elastic Body Contact Step>>

The elastic body contact step is a step of relatively moving the die 5 and the blank holder 7 toward the punch 3 with the ends 51*a* and 51*b* of the metal sheet 51 held by the die 5 and the blank holder 7 and making the contact surface portion 9*a* of the elastic body 9 caused to protrude beyond the punch-side forming surface portion 3*c* of the punch 3 in contact with the metal sheet 51.

The protrusion amount of the elastic body 9 from the punch-side forming surface portion 3*c* is set such that when the die 5 is relatively moved toward the punch 3, the contact surface portion 9*a* of the elastic body 9 contacts the metal sheet 51 before the ridgeline 3*a* of the punch 3 contacts the metal sheet 51 and causes the metal sheet 51 to become plastically deformed, and is set to enable the elastic body 9 to become deformed (contract in the press forming direction) until becoming flush with the punch-side forming surface portion 3*c* at the bottom dead center of forming.

It can be determined that the plastic deformation of the metal sheet 51 by the ridgeline 3*a* occurs when the strain of the portion of the metal sheet 51 with which the ridgeline 3*a* has made contact exceeds a strain ε0 calculated by Expression (1) below, for example.

$$\varepsilon 0 = t/2R \tag{1}$$

where R is the curvature radius of the bending of the character line 63, whereas t is the thickness of the metal sheet 51.

The protrusion amount of the elastic body 9 may be set such that the contact surface portion 9*a* of the elastic body 9 contacts the metal sheet 51 prior to the ridgeline 3*a* of the punch 3. The contact surface portion 9*a* of the elastic body 9 can surely be made in contact with the metal sheet 51 before the ridgeline 3*a* of the punch 3 contacts the metal sheet 51 and causes the metal sheet 51 to become plastically deformed, and as a result, plastic deformation can be performed by the ridgeline 3*a* after the slippage of the metal sheet 51 by the tension difference between the end 51*a* and the end 51*b* on both sides of the metal sheet 51 ends, and thus the skid line can be prevented.

<<Character Line Forming Step>>

The character line forming step is a step of further relatively moving the die 5 toward the punch 3 while making the contact surface portion 9*a* of the elastic body 9 protruding beyond the punch-side forming surface portion 3*c* in contact with the punch 3 side of the metal sheet 51, causing the contact surface portion 9*a* of the elastic body 9 to be crushed and to become deformed so as to be flush with the punch-side forming surface portion 3*c* at the bottom dead center of forming, and forming the character line 63 by the ridgeline 3*a* of the punch 3 and the valley line 5*a* of the die 5.

At the bottom dead center of forming, the punch-side forming surface portion 3*b* forms the panel surface portion 65*a* in cooperation with the die-side forming surface portion 5*b*, and the punch-side forming surface portion 3*c* and the contact surface portion 9*a*, which have been flush with each other, form the panel surface portion 65*b* in cooperation with the die-side forming surface portion 5*c*.

<Reason Why Skid Line is Prevented>

The following describes the reason why the automotive outer panel 61 can be press formed with the skid line prevented by the method for press forming and the apparatus 1 for press forming the automotive outer panel 61 according to the first embodiment based on FIG. 2.

First, the contact surface portion 9*a* of the elastic body 9 protruding beyond the punch-side forming surface portion 3*c* contacts the metal sheet 51 (FIGS. 2(*a*) and 2(*b*)).

Next, the die 5 relatively moves toward the punch 3 while the contact surface portion 9*a* is made in contact with the punch 3 side of the metal sheet 51, and the ridgeline 3*a* of the punch 3 contacts the metal sheet 51 (FIG. 2(*c*)). During this process, the slippage of the metal sheet 51 by the tension difference between the end 51*a* side and the end 51*b* side of the metal sheet 51 proceeds.

During this process, when the die 5 is relatively moved toward the punch 3 while the contact surface portion 9*a* of the elastic body 9 is made in contact with the metal sheet 51, the elastic body 9 becomes deformed as press forming proceeds. Thus, a portion of the metal sheet 51 with which the ridgeline 3*a* and the elastic body 9 make contact gradually undergoes bending deformation to become a gentle shape, and the occurrence of the initial bending fold by plastic deformation can be prevented. Further, when plastic deformation is started, the metal sheet 51 is held between the elastic body 9 and the die-side forming surface portion 5*c*, thus making it unlikely to cause slippage.

Thus, even when the portion with which the ridgeline 3*a* and the elastic body 9 make contact is moved toward the end 51*b* side with high tension by the tension difference occurring in the metal sheet 51 in the press forming process (refer to FIG. 7) and is held between the die-side forming surface portion 5*b* and the punch-side forming surface portion 3*b* at the bottom dead center of forming, the occurrence of the initial bending fold is prevented in the metal sheet 51, and thus the automotive outer panel 61 formed with the character line 63 can be press formed without causing the skid line.

In the first embodiment, the position at which the elastic body 9 is made in contact with the metal sheet 51 is preferably a position separate from the portion 53 corresponding to the character line 63. This is to make it easier for the elastic body 9 to support the metal sheet 51 before the ridgeline 3*a* of the punch 3 contacts the metal sheet 51. As in the automotive outer panel 61 illustrated in FIG. 2, for example, the elastic body 9 may be made in contact with the portion 55*b* corresponding to the panel surface portion 65*b* along the portion 53 corresponding to the character line 63.

<Another Mode>

As illustrated in FIG. 2, in the method for press forming and the apparatus 1 for press forming according to the first embodiment described above, the elastic body 9 protruding beyond the punch-side forming surface portion 3*c* is brought into contact with the portion 55*b* on the side with high tension in the metal sheet 51 to make the bending deformation by the ridgeline 3*a* a gentle shape in the press forming process, and the elastic body 9 is crushed at the bottom dead center of forming to form the character line 63.

Figure 3:
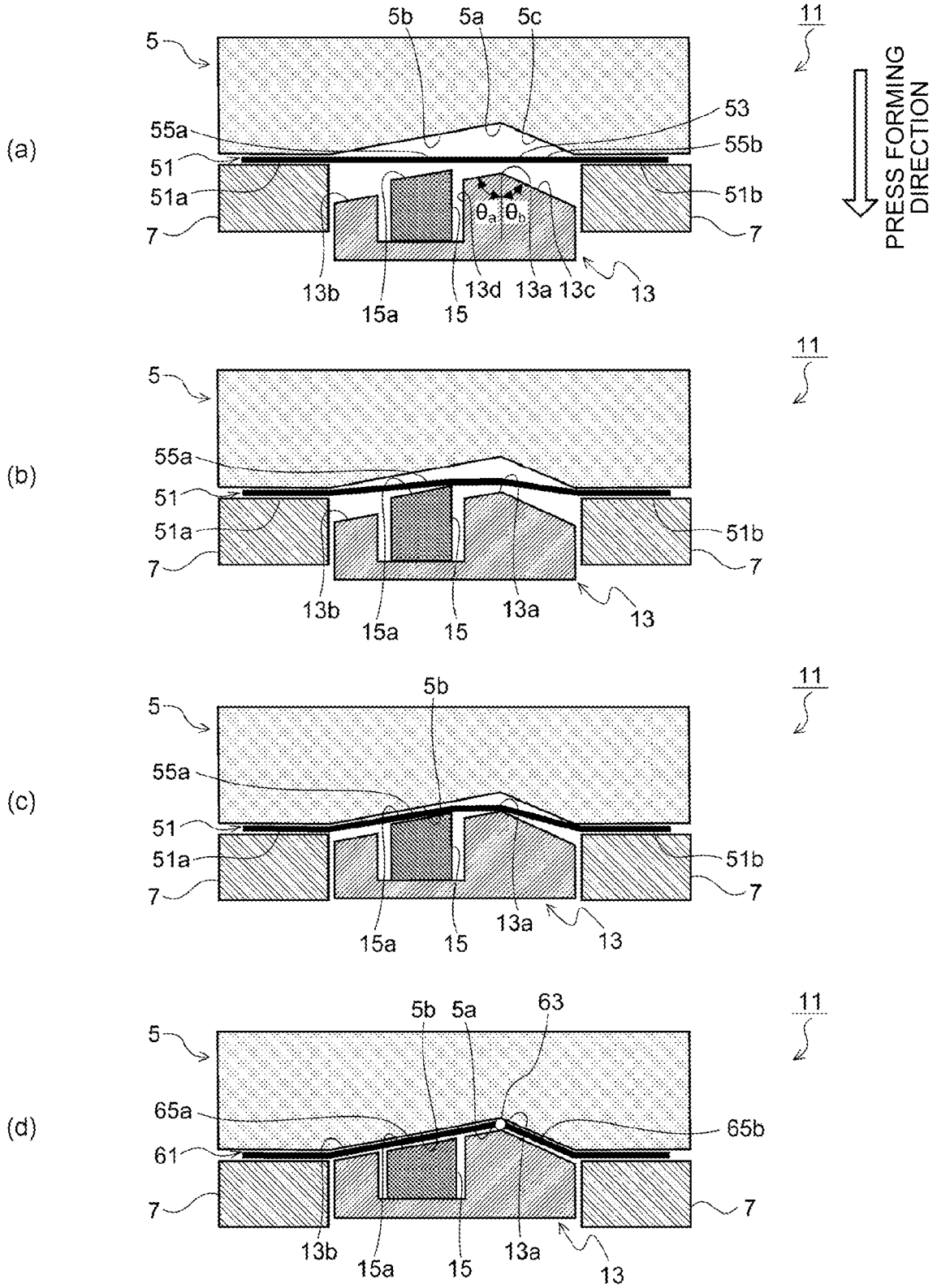
FIG. 3 is a diagram illustrating another mode of the apparatus for press forming and the method for press forming an automotive outer panel according to the first embodiment of the present invention.

However, as another mode of the first embodiment of the present invention, as illustrated in FIG. 3, an apparatus 11 for press forming, in which an elastic body 15 protruding beyond a punch-side forming surface portion 13*b* is brought into contact with the portion 55*a* on the side with low tension in the metal sheet 51 in the press forming process, may be used.

As illustrated in FIG. 3, the apparatus 11 for press forming includes a punch 13, the die 5, the blank holder 7, and the elastic body 15. Among the components of the apparatus 11 for press forming, the die 5 and the blank holder 7 are the same as those of the apparatus 1 for press forming described above (FIG. 1 and FIG. 2), and the following describes the punch 13 and the elastic body 15.

The punch 13 has a ridgeline 13*a*, punch-side forming surface portions 13*b* and 13*c* continuous with both sides across the ridgeline 13*a*, and a groove 13*d* formed in the punch-side forming surface portion 13*b* in a concave shape.

The ridgeline 13*a* forms the character line 63 (FIG. 3(*d*)) in cooperation with the valley line 5*a* of the die 5. The punch-side forming surface portion 13*b* forms the portion 55*a* on the side in which the tension acting on the metal sheet 51 is small in the press forming process into the panel surface portion 65*a*. On the other hand, the punch-side forming surface portion 13*c* forms the portion 55*b* on the side in which the tension acting on the metal sheet 51 is large in the press forming process into the panel surface portion 65*b*.

The groove 13*d* is formed in a concave shape in the punch-side forming surface portion 13*b* and is provided with the elastic body 15. The boundary of the groove 13*d* closer to the ridgeline 13*a* may be separated from the ridgeline 13*a* by 10% or more of the length of the punch-side forming surface portion 13*b*.

The elastic body 15 is provided in the groove 13*d* formed in the punch-side forming surface portion 13*b* so as to be capable of contacting a position separate from the portion 53 corresponding to the character line 63 in the metal sheet 51 along the portion 53 and is supported on the bottom of the groove 13*d* so as to protrude toward the die 5 beyond the punch-side forming surface portion 13*b* and to be capable of becoming deformed until a contact surface portion 15*a* in contact with the metal sheet 51 becomes flush with the punch-side forming surface portion 13*b*.

In the press forming of the automotive outer panel 61 using such an apparatus 11 for press forming, first, the die 5 is relatively moved toward the punch 13 with the ends 51*a* and 51*b* of the metal sheet 51 held by the die 5 and the blank holder 7, and the contact surface portion 15*a* of the elastic body 15 caused to protrude beyond the punch-side forming surface portion 13*b* of the punch 13 is made in contact with the metal sheet 51 (the elastic body contact step, FIGS. 3(*a*) and 3(*b*)).

A protrusion amount of the elastic body 15 from the punch-side forming surface portion 13*b* is set such that when the die 5 is relatively moved toward the punch 13, the contact surface portion 15*a* of the elastic body 15 contacts the metal sheet 51 before the ridgeline 13*a* of the punch 13 contacts the metal sheet 51 to cause the metal sheet 51 to become plastically deformed. Thus, even when the tension difference between the ends 51*a* and 51*b* on both sides of the metal sheet 51 occurs, the slippage of the metal sheet 51 proceeds before the plastic deformation of the metal sheet 51 by the ridgeline 13*a* starts.

The protrusion amount of the elastic body 15 from the punch-side forming surface portion 13*b* is set such that when the die 5 is relatively moved toward the punch 13, the contact surface portion 15*a* of the elastic body 15 contacts the metal sheet 51 before the ridgeline 13*a* of the punch 13 contacts the metal sheet 51 to cause the metal sheet 51 to become plastically deformed, and is set to enable the elastic body 15 to become deformed until becoming flush with the punch-side forming surface portion 13*b* at the bottom dead center of forming.

Next, the die 5 is further relatively moved toward the punch 13 while making the contact surface portion 15*a* of the elastic body 15 protruding beyond the punch-side forming surface portion 13*b* in contact with the punch 13 side of the metal sheet 51, the contact surface portion 15*a* of the elastic body 15 is crushed to be flush with the punch-side forming surface portion 13*b* at the bottom dead center of forming, and the character line 63 is formed by the ridgeline 13*a* of the punch 13 and the valley line 5*a* of the die 5 (the character line forming step, FIGS. 3(*c*) and 3(*d*)).

Thus, even in the mode in which the elastic body 15 protruding beyond the punch-side forming surface portion 13*b* is brought into contact with the portion 55*a* on the side with low tension in the metal sheet 51 and press forming is performed, the elastic body 15 becomes deformed along with the progress of press forming, whereby the portion with which the ridgeline 13*a* and the elastic body 15 make contact gradually becomes deformed to make a bent shape gentle, and the occurrence of the initial bending fold by plastic deformation can be prevented. Further, when plastic deformation by the ridgeline 13*a* of the punch 13 is started, the metal sheet 51 is held between the contact surface portion 15*a* of the elastic body 15 and the die-side forming surface portion 5*b*, thus making it unlikely to cause slippage.

Thus, even when the slipping of the metal sheet 51 occurs on the end 51*b* side with high tension in the press forming process, the automotive outer panel 61 formed with the character line 63 can be press formed without causing the skid line.

As for the elastic body 15 made in contact with the portion 55*a* on the end 51*a* side with low tension, the elastic body 15 protrudes beyond the punch-side forming surface portion 3*b* to enable the bending deformation of the metal sheet 51 by the ridgeline 3*a* to be a gentle shape while the elastic body 9 is in contact with the metal sheet 51 up to the bottom dead center of forming. And the elastic body 9 may have a hardness and a shape being capable of becoming deformed along a shape of a tool of press forming (the shape of the punch-side forming surface portion 13*b*) at the bottom dead center of forming; examples thereof include a rubber material and a urethane material having a Shore hardness of 40 to 100 HS.

Second Embodiment

<Apparatus for Press Forming>

Figure 4:
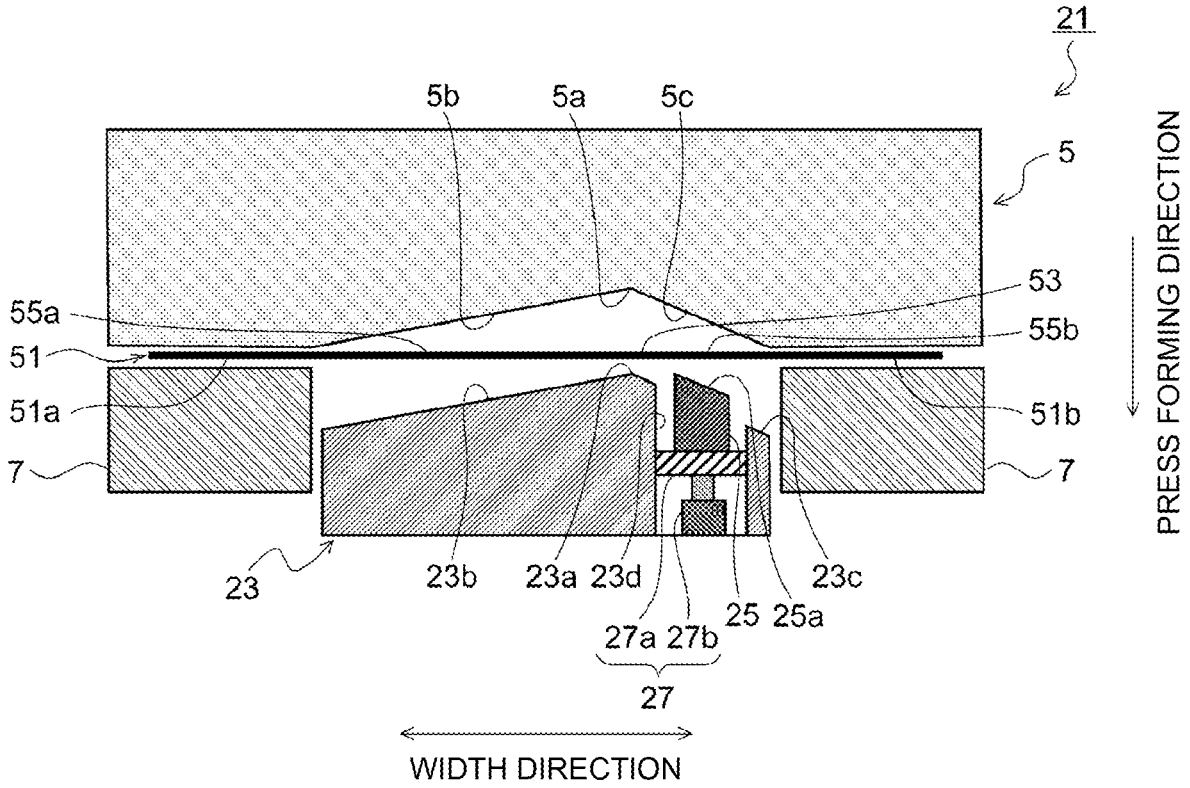
FIG. 4 is a diagram illustrating an apparatus for press forming an automotive outer panel according to a second embodiment of the present invention.
Figure 5:
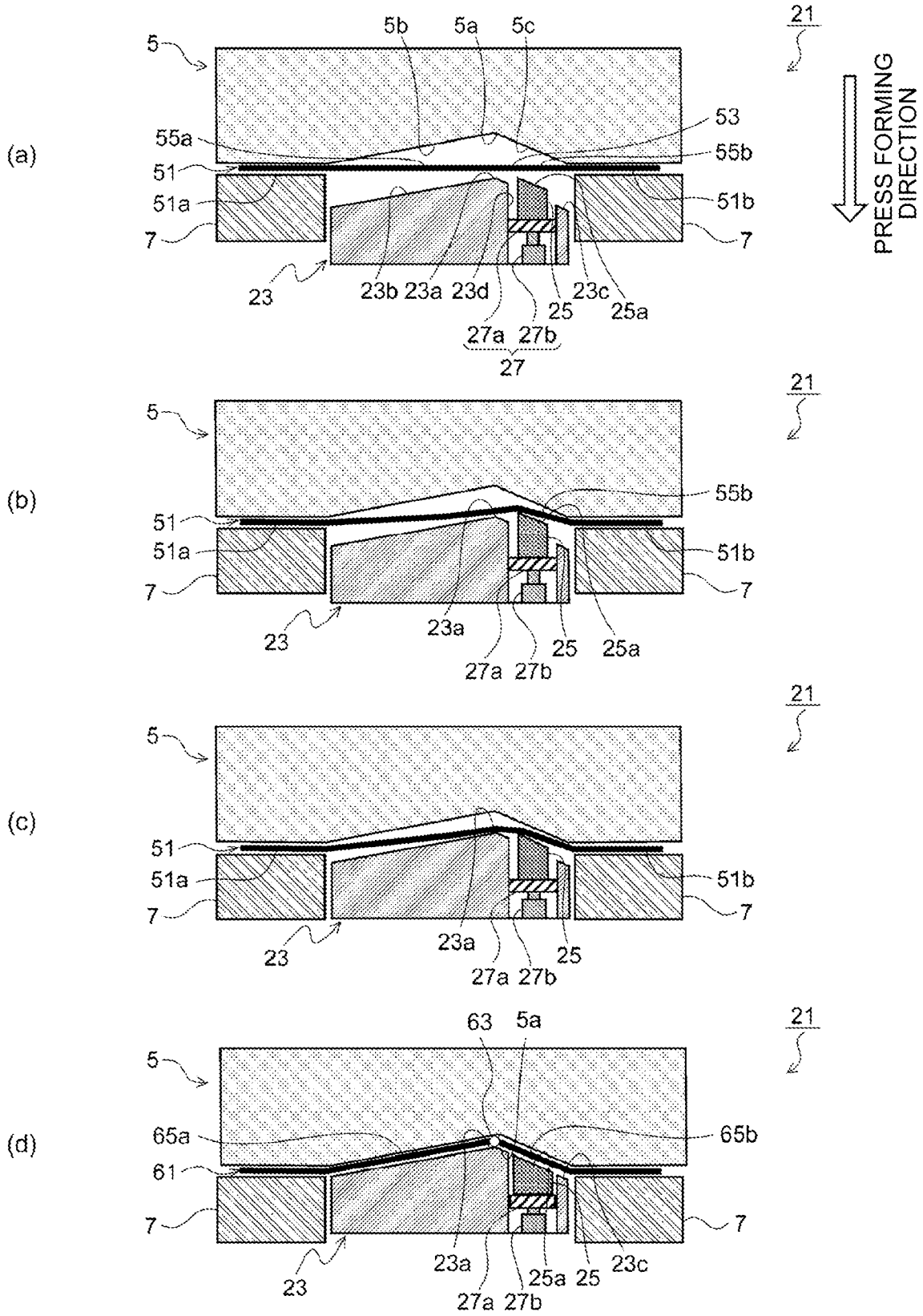
FIG. 5 is a diagram illustrating a method for press forming an automotive outer panel according to the second embodiment of the present invention.

As illustrated in FIG. 4 and FIG. 5, this apparatus 21 for press forming an automotive outer panel according to the second embodiment (hereinafter, referred to simply as an "apparatus 21 for press forming") press forms the metal sheet 51 into the automotive outer panel 61 having the character line 63 and the panel surface portions 65*a* and 65*b* continuous with both sides thereof and includes a punch 23, the die 5, the blank holder 7, an elastic body 25, and a movable device 27.

The die 5 and the blank holder 7 are the same as those of the apparatus 1 for press forming according to the first embodiment described above, and the following describes the punch 23, the elastic body 25, and the movable device 27.

The punch 23 has a ridgeline 23*a*, punch-side forming surface portions 23*b* and 23*c* continuous with both sides across the ridgeline 23*a*, and a groove 23*d* formed in a concave shape in the punch-side forming surface portion 23*c*, in the same manner as the punch 3 of the apparatus 1 for press forming according to the first embodiment described above.

The ridgeline 23*a* forms the character line 63 (FIG. 5(*d*)) in cooperation with the valley line 5*a* of the die 5. The punch-side forming surface portions 23*b* and 23*c* form the panel surface portions 65*a* and 65*b*, respectively (FIG. 5(*d*)), in cooperation with the die-side forming surface portions 5*b* and 5*c*, respectively.

The punch-side forming surface portion 23*b* forms the portion 55*a* on the end 51*a* side in which the tension acting on the metal sheet 51 is small in the press forming process into the panel surface portion 65*a*. On the other hand, the punch-side forming surface portion 23*c* forms the portion 55*b* on the end 51*b* side in which the tension acting on the metal sheet 51 is large in the press forming process into the panel surface portion 65*b*.

The groove 23*d* is formed in a concave shape in the punch-side forming surface portion 23*c* and is provided with the elastic body 25 and the movable device 27. The boundary of the groove 23*d* closer to the ridgeline 23*a* is preferably separated from the ridgeline 23*a* by 10% or more of the length of the punch-side forming surface portion 23*c*.

The elastic body 25 is provided in the groove 23*d* of the punch-side forming surface portion 23*c* so as to be capable of contacting and supporting a position separate from the portion 53 corresponding to the character line 63 in the metal sheet 51 along the portion 53 and is provided in the groove 23*d* so as to protrude toward the die 5 beyond the punch-side forming surface portion 23*c* and to be capable of becoming deformed (contracting in the press forming direction) until a contact surface portion 25*a* in contact with the metal sheet 51 becomes flush with the punch-side forming surface portion 23*c*. Further, the elastic body 25 is supported on the bottom of the groove 23*d* via the movable device 27.

The movable device 27 supports the elastic body 25 within the groove 23*d* so as to pressurize the elastic body 25 toward the die 5 and to enable the elastic body 25 to come into contact with the metal sheet 51 and includes a pad 27*a* on which the elastic body 25 is mounted and movable along the press forming direction and a pressure source 27*b* exerting pressure on the pad 27*a*. Examples of the pressure source 27*b* include a gas cushion and urethane.

In the apparatus 21 for press forming according to the second embodiment, a protrusion amount of the elastic body 25 from the punch-side forming surface portion 23*c* is set such that when the die 5 is relatively moved toward the punch 23, the contact surface portion 25*a* contacts the metal sheet 51 before the portion in contact with the ridgeline 23*a* of the punch 23 in the metal sheet 51 is plastically deformed. Even when a tension difference between the end 51*a* and the end 51*b* on both sides of the metal sheet 51 occurs, the slippage of the metal sheet 51 proceeds before the plastic deformation of the metal sheet 51 by the ridgeline 23*a* starts. Further when plastic deformation is started, the metal sheet 51 is held between the elastic body 25 and the die-side forming surface portion 5*c*, thus making it unlikely to cause slippage.

The elastic body 25 abuts on the metal sheet 51, while the elastic body 25 protrudes beyond the punch-side forming surface portion 23*c*, to make the bent shape of the metal sheet 51 by the ridgeline 23*a* gentle up to the bottom dead center of forming. And the elastic body 9 may have hardness and a shape being capable of becoming deformed along a shape of a tool of press forming (the shape of the punch-side forming surface portion 23*c*) at the bottom dead center of forming. Examples of a specific material of such an elastic body 25 include a rubber material and a urethane material having a Shore hardness of 40 to 100 HS.

Further, in the movable device 27, the pressure of the pressure source 27*b* pressurizing the elastic body 25 toward the die 5 is set such that the elastic body 25 crushed in the press forming process is pushed back toward the bottom side of the groove 23*d*, and the contact surface portion 25*a* of the elastic body 25 having been crushed and deformed (contracted) becomes flush with the punch-side forming surface portion 23*c* at the bottom dead center of forming.

<Method for Press Forming>

As to the method for press forming the automotive outer panel 61 according to the second embodiment, the following describes a case in which the automotive outer panel 61 formed with the character line 63 illustrated in FIG. 5(*d*) is press formed using the apparatus 21 for press forming exemplified in FIG. 4.

As illustrated in FIG. 4 and FIG. 5, the method for press forming the automotive outer panel 61 according to the second embodiment uses the apparatus 21 for press forming including the punch 23, the die 5, the blank holder 7, the elastic body 25, and the movable device 27 to press form the automotive outer panel 61 having the character line 63 and the panel surface portions 65*a* and 65*b* continuous with both sides thereof and includes an elastic body contact step relatively moving the die 5 toward the punch 23 to make the elastic body 25 in contact with the metal sheet 51 and a character line forming step crushing the elastic body 25 at the bottom dead center of forming to form the character line 63 by the ridgeline 23*a* of the punch 23 and the valley line 5*a* of the die 5.

As described above, the elastic body 25 is provided in the groove 23*d* formed in the punch-side forming surface portion 23*c* and is supported on the bottom of the groove 23*d* so as to protrude toward the die 5 beyond the punch-side forming surface portion 23*c* so as to be capable of contacting the position separate from the portion 53 corresponding to the character line 63 in the metal sheet 51 along the portion 53 and to be capable of becoming deformed (contracting) until the contact surface portion 25*a* in contact with the metal sheet 51 becomes flush with the punch-side forming surface portion 23*c*. The following describes the elastic body contact step and the character line forming step.

<<Elastic Body Contact Step>>

The elastic body contact step is a step of relatively moving the die 5 toward the punch 23 with the ends 51*a* and 51*b* of the metal sheet 51 held by the die 5 and the blank holder 7 and making the contact surface portion 25*a* of the elastic body 25 caused to protrude beyond the punch-side forming surface portion 23*c* of the punch 23 in contact with the metal sheet 51.

The protrusion amount of the elastic body 25 from the punch-side forming surface portion 23*c* is set such that when the die 5 is relatively moved toward the punch 23, the contact surface portion 25*a* of the elastic body 25 contacts the metal sheet 51 before the ridgeline 23*a* of the punch 23 contacts the metal sheet 51 and causes the metal sheet 51 to become plastically deformed.

It may be determined that the plastic deformation of the metal sheet 51 by the ridgeline 23*a* occurs when the strain of the portion of the metal sheet 51 with which the ridgeline 23*a* has made contact exceeds the strain ε0 calculated by Expression (1) described above, for example.

<<Character Line Forming Step>>

The character line forming step is a step of further relatively moving the die 5 toward the punch 23 up to the bottom dead center of forming while making the contact surface portion 25*a* of the elastic body 25 in contact with the punch 23 side of the metal sheet 51 to make a bent shape by the ridgeline 23*a* gentle, crushing the contact surface portion 25*a* of the elastic body 25 to be flush with the punch-side forming surface portion 23*c* at the bottom dead center of forming, and forming the character line 63 by the ridgeline 23*a* of the punch 23 and the valley line 5*a* of the die 5.

In the character line forming step, when the die 5 is relatively moved toward the punch 23, the elastic body 25 pressed and supported on the die 5 side by the pressure source 27*b* of the movable device 27 is crushed and deformed (contracted) and is pushed back toward the bottom of the groove 23*d* together with the pad 27*a* of the movable device 27.

At the bottom dead center of forming, the punch-side forming surface portion 23*b* and the die-side forming surface portion 5*b* form the panel surface portion 65*a*, whereas the punch-side forming surface portion 23*c* and the contact surface portion 25*a*, which have been flush with each other by the elastic body 25 having been crushed, and the die-side forming surface portion 5*c* form the panel surface portion 65*b*.

<Effects>

The effects of the method for press forming and the apparatus 21 for press forming according to the second embodiment are as follows. As illustrated in FIG. 5, when the die 5 is relatively moved toward the punch 23 while making the elastic body 25 supported on the bottom of the groove 23*d* of the punch-side forming surface portion 23*c* via the movable device 27 is brought into contact with the metal sheet 51. The portion of the metal sheet 51 with which the ridgeline 23*a* of the punch 23 and the contact surface portion 25*a* of the elastic body 25 make contact gradually undergoes bending deformation to become a gentle shape, and the occurrence of the initial bending fold by plastic deformation can be prevented.

Thus, in the same manner as the first embodiment described above, even when the portion with which the ridgeline 23*a* and the elastic body 25 make contact is moved toward the end 51*b* side with high tension by the tension difference between the end 51*a* side and the end 51*b* side of the metal sheet 51 in the press forming process and is held between the die-side forming surface portion 5*b* and the punch-side forming surface portion 23*c* at the bottom dead center of forming, the occurrence of the initial bending fold is prevented in the metal sheet 51, and thus the automotive outer panel 61 formed with the character line 63 can be press formed without causing the skid line in the panel surface portion 65*b*.

Further, the elastic body 25 is pressed and supported on the die 5 side by the pressure source 27*b* of the movable device 27, and thus even when the elastic body 25 becomes deformed (contracted) by the relative movement of the die 5 toward the punch 23, the elastic body 25 can be contact with the metal sheet 51 and supported while being pressurized toward the die 5.

When compared with the first embodiment described above, in the second embodiment, in addition to changes in the material, shape, and dimension of the elastic body 25, the pressure of the pressure source 27*b* supporting the elastic body 25 is adjusted, whereby press forming can be performed with an increased degree of freedom for making the bending deformation of the portion, where the ridgeline 23*a* and the contact surface portion 25*a* of the elastic body 25 abut in the metal sheet 51, a gentle shape.

<Another Mode>

In the method for press forming and the apparatus 21 for press forming the automotive outer panel 61 according to the second embodiment described above, the elastic body 25 supported by the movable device 27 is brought into contact with the portion 55*b* on the side with high tension in the metal sheet 51, while the elastic body 27 is pressurized toward the die 5. The die 5 is relatively moved to the punch 23 side, and the character line 63 is formed by the ridgeline 23*a* of the punch 23 and the valley line 5*a* of the die 5 at the bottom dead center of forming.

Figure 6:
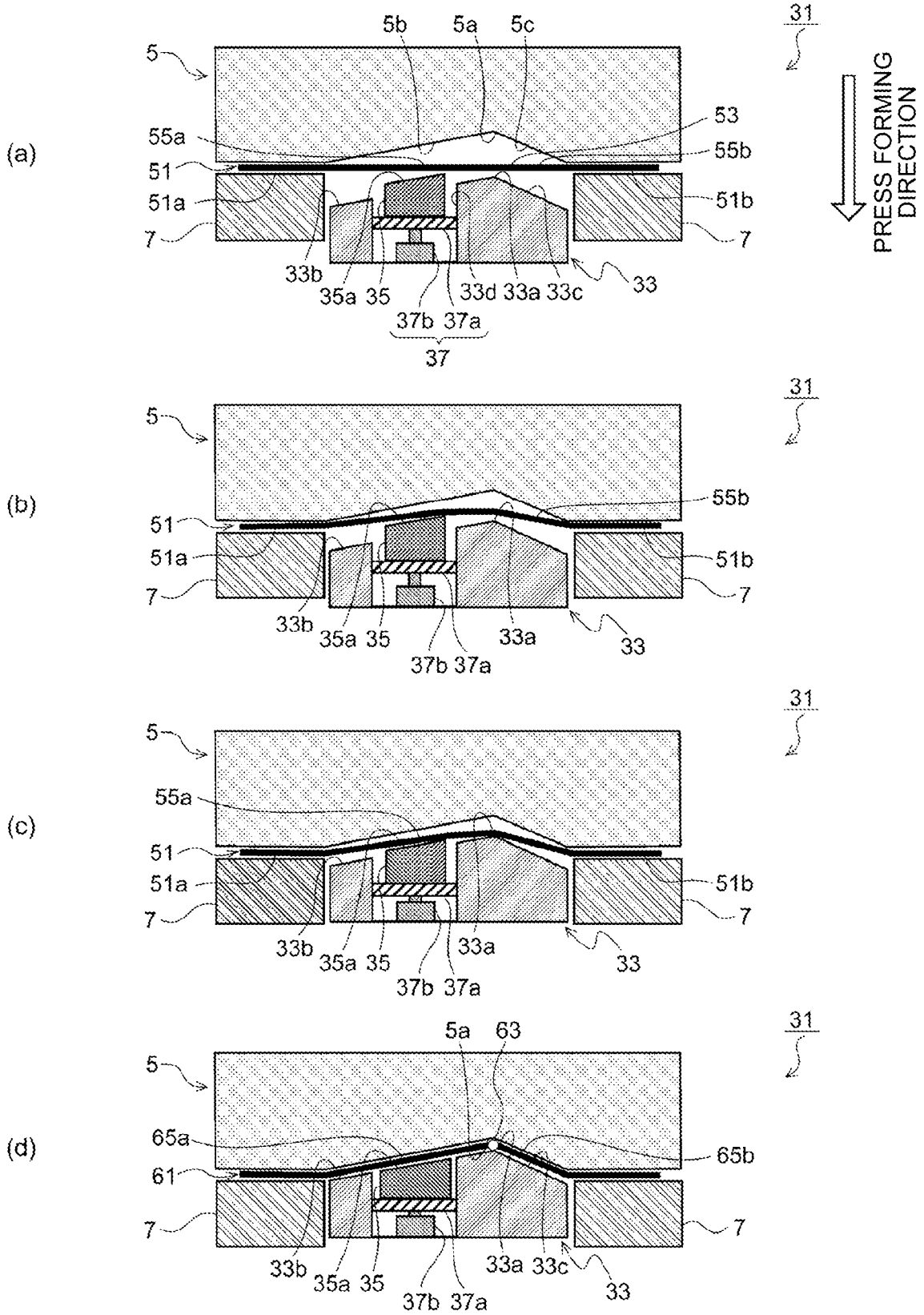
FIG. 6 is a diagram illustrating another mode of the apparatus for press forming and the method for press forming an automotive outer panel according to the second embodiment of the present invention.

However, as another mode of the second embodiment of the present invention, as illustrated in FIG. 6, an apparatus 31 for press forming, in which an elastic body 35 supported by a movable device 37 is brought into contact with the portion 55*a* on the side with low tension in the metal sheet 51, may be used.

As illustrated in FIG. 6, the apparatus 31 for press forming includes a punch 33, the die 5, the blank holder 7, the elastic body 35, and the movable device 37. The die 5 and the blank holder 7 are the same as those of the apparatus 1 for press forming described above, and the following describes the punch 33, the elastic body 35, and the movable device 37.

The punch 33 has a ridgeline 33*a*, punch-side forming surface portions 33*b* and 33*c* continuous with both sides across the ridgeline 33*a*, and a groove 33*d* formed in a concave shape in the punch-side forming surface portion 33*b*.

The ridgeline 33*a* forms the character line 63 (FIG. 6(*d*)) in cooperation with the valley line 5*a* of the die 5. The punch-side forming surface portion 33*b* forms the portion 55*a* in which the tension acting on the metal sheet 51 is small in the press forming process into the panel surface portion 65*a*. On the other hand, the punch-side forming surface portion 33*c* forms the portion 55*b* in which the tension acting on the metal sheet 51 is large in the press forming process into the panel surface portion 65*b*.

The groove 33*d* is formed in a concave shape in the punch-side forming surface portion 33*b* and is provided with the elastic body 35 and the movable device 37. The boundary of the groove 33*d* closer to the ridgeline 33*a* is preferably separated from the ridgeline 33*a* by 10% or more of the length of the punch-side forming surface portion 33*b*.

The elastic body 35 is provided in the groove 33*d* of the punch-side forming surface portion 33*b* so as to be capable of contacting and supporting a position separate from the portion 53 corresponding to the character line 63 in the metal sheet 51 along the portion 53 and is provided in the groove 33*d* so as to protrude toward the die 5 from the punch-side forming surface portion 33*b* and to be capable of becoming deformed (contracting in the press forming direction) until a contact surface portion 35*a* in contact with the metal sheet 51 becomes flush with the punch-side forming surface portion 33*b*. Further, the elastic body 35 is supported on the bottom of the groove 33*d* via the movable device 37.

The movable device 37 supports the elastic body 35 on the bottom of the groove 33*d* so as to pressurize the elastic body 35 toward the die 5 and to enable the elastic body 35 to come into contact with the metal sheet 51 and includes a pad 37*a* on which the elastic body 35 is mounted and movable along the press forming direction and a pressure source 37*b* exerting pressure on the pad 37*a*.

A protrusion amount of the elastic body 35 from the punch-side forming surface portion 33*b* is set such that when the die 5 is relatively moved toward the punch 33, the contact surface portion 35*a* contacts the metal sheet 51 before a portion in contact with the ridgeline 33*a* of the punch 33 in the metal sheet 51 is plastically deformed. Thus, even when the tension difference occurs between the end 51*a* side and the end 51*b* side of the metal sheet 51, the slippage of the metal sheet 51 proceeds before the plastic deformation of the metal sheet 51 by the ridgeline 33*a* starts.

Further, in the movable device 37, the pressure of the pressure source 37*b* pressurizing the elastic body 35 toward the die 5 is set such that the crushed elastic body 35 in the press forming process is pushed back toward the bottom side of the groove 33*d*, and the contact surface portion 35*a* of the elastic body 35 having become deformed (contracted) becomes flush with the punch-side forming surface portion 33*c* at the bottom dead center of forming. Thus, when the plastic deformation of the character line 63 is started, the metal sheet 51 is held between the elastic body 35 and the die-side forming surface portion 5*c*, thus making it unlikely to cause slippage.

In the press forming of the automotive outer panel 61 using such an apparatus 31 for press forming, first, the die 5 is relatively moved toward the punch 33 with the ends 51*a* and 51*b* of the metal sheet 51 held by the die 5 and the blank holder 7, and the contact surface portion 35*a* of the elastic body 35 caused to protrude beyond the punch-side forming surface portion 33*b* of the punch 33 is made in contact with the metal sheet 51 (the elastic body contact step, FIGS. 6(*a*) and 6(*b*)).

Subsequently, the die 5 is further relatively moved toward the punch 33 while making the contact surface portion 35*a* of the elastic body 35 pressurized toward the die 5 in contact with the metal sheet 51, the contact surface portion 35*a* of the elastic body 35 is crushed to be flush with the punch-side forming surface portion 35*b* at the bottom dead center of forming, and the character line 63 is formed by the ridgeline 33*a* of the punch 33 and the valley line 5*a* of the die 5 (the character line forming step, FIGS. 6(*c*) and 6(*d*)).

Thus, even in the mode in which the elastic body 35 protruding beyond the punch-side forming surface portion 33*b* is brought into contact with the portion 55*a* on the side with low tension in the metal sheet 51 and press forming is performed, the elastic body 35 becomes deformed along with the progress of press forming, whereby the portion with which the ridgeline 33*a* and the elastic body 35 make contact gradually becomes deformed to be a gentle bent shape, and the occurrence of the initial bending fold by plastic deformation can be prevented.

Thus, even when the slipping of the metal sheet 51 occurs on the end 51*b* side with high tension in the press forming process, the automotive outer panel 61 formed with the character line 63 can be press formed without causing the skid line.

In addition, in the other mode of the second embodiment, in addition to changing the material of the elastic body 35, the pressure of the pressure source 37*b* supporting the elastic body 35 can be adjusted. Thus, compared with the first embodiment described above, press forming can be performed with an increased degree of freedom for making the bending deformation of the portion, where the ridgeline 33*a* and the contact surface portion 35*a* of the elastic body 35 abut in the metal sheet 51, a gentle shape.

Example

An example verifying a skid line prevention effect when an automotive outer panel is press formed to form a character line by the method for press forming and the apparatus for press forming an automotive outer panel according to aspects of the present invention was performed; the following described this example.

In the present example, press forming analysis press forming an outer panel simulating an automotive outer panel having a character line by the method for press forming according to aspects of the present invention was performed to evaluate the presence or absence of the occurrence of the skid line in the press formed outer panel.

In the press forming analysis, using a steel sheet SGCC-F with a thickness of 0.7 mm as a metal sheet, an outer panel (not illustrated) having a character line and panel surface portions continuous with both sides thereof was analyzed.

A curvature radius R of the character line was 3 mm, the angles of the panel surface portions with respect to a press forming direction were $\theta a=85°$ and $\theta b=65°$, and the widths of the panel surface portions (the lengths from the boundaries with the character line to the ends) were 500 mm for the width of the panel surface portion with $\theta a=85°$ and 200 mm for the width of the panel surface portion with $\theta b=65°$.

In the present example, as a conventional example, press forming analysis for the process of deep drawing a metal sheet into an outer panel by an apparatus for press forming including a punch, a die, and a blank holder (refer to FIG. 7) was performed.

It has been confirmed that the panel surface portion side with a smaller angle ($\theta b=65°$) is larger than the panel surface portion side with a larger angle ($\theta a=85°$) in a tension occurring in a press forming process.

Next, as an inventive example, using an apparatus for press forming including a punch, a die, a blank holder, and an elastic body, press forming analysis of a process of performing deep drawing for forming the character line at the forming bottom dead point by gradually performing bending deformation to the portion of the metal sheet with which the ridgeline of the punch and the contact surface of the elastic body make contact to shape the portion into a gentle shape while making the elastic body in contact with a position separate from a portion corresponding to the character line in the metal sheet (refer to FIG. 2) was performed.

The elastic body was provided in the groove of the punch-side forming surface portion caused to protrude from the punch-side forming surface portion toward the die by 5 mm so as to be capable of contacting the position separate from the portion of the metal sheet corresponding to the character line along the portion and of pressing the position.

A protrusion amount of the elastic body from the punch-side forming surface portion was set such that a contact surface portion of the elastic body contacts the metal sheet before a ridgeline of the punch contacts the metal sheet and becomes plastically deformed. In the press analysis, the material of the elastic body was hard urethane, whereas the elastic modulus of the elastic body was 253 N/mm.

Figure 8:
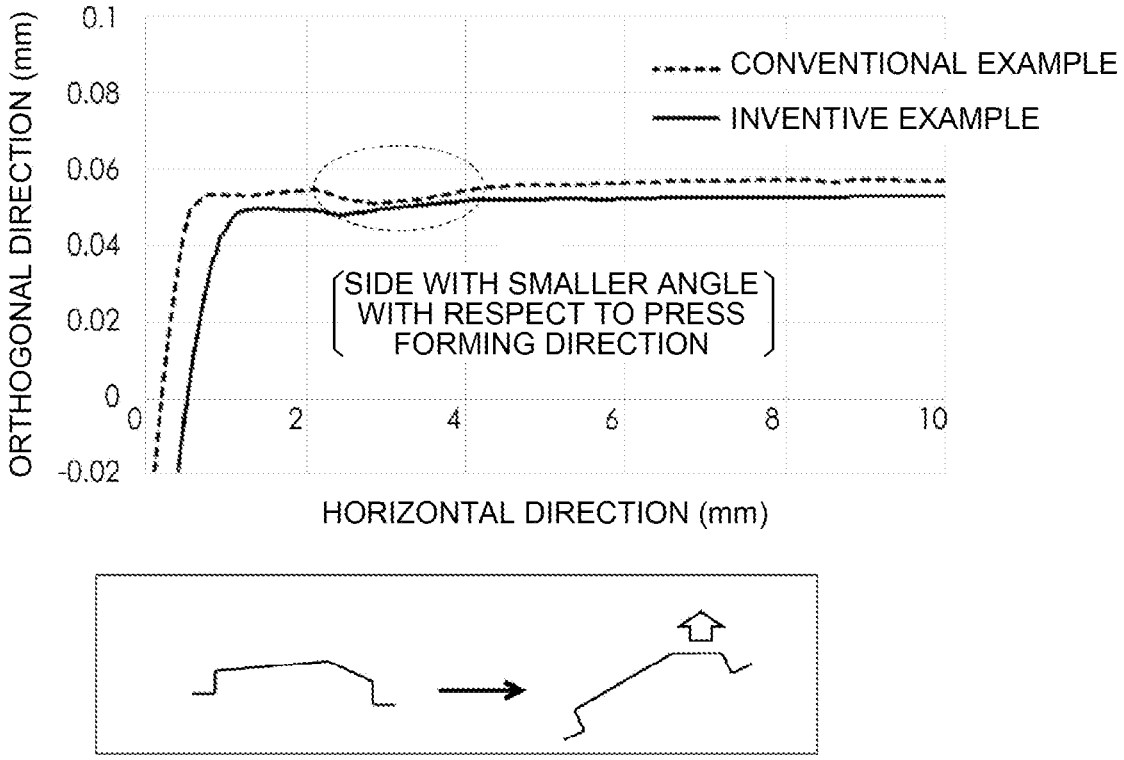
FIG. 8 is a diagram of a result of a sectional shape of an outer panel determined by press forming analysis in an example.

FIG. 8 illustrates a result of a sectional shape of the outer panel obtained by the press forming analysis. FIG. 8 places the result of the sectional shape rotated such that the panel surface portion with a smaller angle with respect to the press forming direction is horizontal and illustrates the sectional shape of the portion of the press formed outer panel around the character line in an enlarged manner on a coordinated plane with a horizontal direction parallel to the panel surface portion as a horizontal axis and with an orthogonal direction with respect to the panel surface portion as a vertical axis.

From FIG. 8, compared with the inventive example, in the conventional example, a concave shape (the portion surrounded by the dotted ellipse in FIG. 8) caused by the skid line was observed in the panel surface portion with high tension per unit area.

Figure 9:
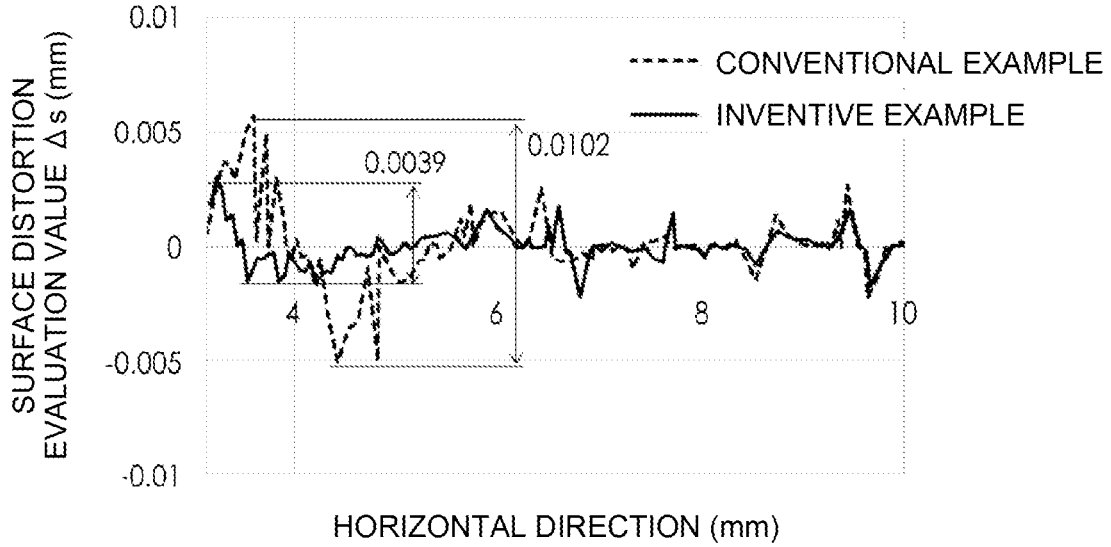
FIG. 9 is a diagram of a result of an evaluation value Δs of surface distortion of the outer panel determined by the press forming analysis in the example.

FIG. 9 illustrates a result evaluating surface distortion for the outer panel obtained by the press forming analysis. FIG. 9 is a graph with the coordinate of the panel part in the horizontal direction when the panel surface portion with a smaller angle with respect to the press forming direction is placed to be horizontal as a horizontal axis and with an evaluation value Δs of the surface distortion at each horizontal direction position as a vertical axis. The evaluation value Δs of the surface distortion is represented by the difference between the maximum and the minimum of a peak height by a three-point gauge (fixed span L) as described in a known reference described below. (Reference) Edited by the Japan Sheet Metal Forming Research Group, Puresu Seikei Nani Handobukku, 4th Ed, "Chapter 5 Menkeijou Seido Furyou to Seikei Nani Hyouka," pp. 218-221, Nikkan Kogyo Shimbun, Ltd. (2017).

From FIG. 9, the difference between the maximum value and the minimum value of the evaluation value Δs of surface distortion was 0.0102 for the conventional example, whereas it was 0.0039 for the inventive example. It can be seen from this that press forming was performed so as to make the ridgeline of the punch and the contact surface portion of the elastic body in contact with the metal sheet to make the bending deformation a gentle shape, whereby the surface distortion of the panel surface portion reduced.

It has been shown from the foregoing that aspects of the present invention can press form the automotive outer panel formed with the character line with the skid line prevented.

INDUSTRIAL APPLICABILITY

Aspects of the present invention can provide a method for press forming and an apparatus for press forming an automotive outer panel forming an objective character line without being limited by a bending deformation shape, without scratching the surface of a formed product, without causing surface distortion, and with a skid line prevented without increasing the number of man-hours of press forming.

REFERENCE SIGNS LIST

1 APPARATUS FOR PRESS FORMING
3 PUNCH
3*a* RIDGELINE
3*b*, 3*c* PUNCH-SIDE FORMING SURFACE PORTION
3*d* GROOVE
5 DIE
5*a* VALLEY LINE
5*b*, 5*c* DIE-SIDE FORMING SURFACE PORTION
7 BLANK HOLDER
9 ELASTIC BODY
9*a* CONTACT SURFACE PORTION
11 APPARATUS FOR PRESS FORMING
13 PUNCH
13*a* RIDGELINE
13*b*, 13*c* PUNCH-SIDE FORMING SURFACE PORTION
13*d* GROOVE
15 ELASTIC BODY
15*a* CONTACT SURFACE PORTION
21 APPARATUS FOR PRESS FORMING
23 PUNCH
23*a* RIDGELINE
23*b*, 23*c* PUNCH-SIDE FORMING SURFACE PORTION
23*d* GROOVE
25 ELASTIC BODY
25*a* CONTACT SURFACE PORTION
27 MOVABLE DEVICE
27*a* PAD
27*b* PRESSURE SOURCE
31 APPARATUS FOR PRESS FORMING
33 PUNCH
33*a* RIDGELINE
33*b*, 33*c* PUNCH-SIDE FORMING SURFACE PORTION
33*d* GROOVE
35 ELASTIC BODY
35*a* CONTACT SURFACE PORTION
37 MOVABLE DEVICE
37*a* PAD
37*b* PRESSURE SOURCE
41 APPARATUS FOR PRESS FORMING
43 PUNCH
43*a* RIDGELINE
45 DIE
45*a* VALLEY LINE
51 METAL SHEET
53 PORTION
55*a*, 55*b* PORTION
61 AUTOMOTIVE OUTER PANEL

63 CHARACTER LINE
65*a*, 65*b* PANEL SURFACE PORTION

The invention claimed is:

1. A method for press forming an automotive outer panel using a punch having a ridgeline, a die having a valley line facing the punch, and a blank holder facing ends of the die to press form a metal sheet into the automotive outer panel having a character line formed by the ridgeline and the valley line and panel surface portions continuous with both sides of the character line, the method comprising:

providing an elastic body to the punch such that the elastic body abuts against the metal sheet away from a portion corresponding to the character line in the metal sheet, the elastic body press forming one of the panel surface portions and protruding toward the die beyond a punch-side forming surface portion, the elastic body being made of a rubber material or a urethane material;

an elastic body abutting step of abutting a contact surface portion of the protruding elastic body against the metal sheet by relatively moving the die toward the punch with both ends of the metal sheet held between the die and the blank holder; and a character line forming step of forming the character line with the ridgeline and the valley line by further relatively moving the die toward the punch while abutting the contact surface portion of the protruding elastic body against the metal sheet to deform the elastic body such that the elastic body becomes flush with the punch-side forming surface portion at a bottom dead center of forming, wherein a protrusion amount of the elastic body from the punch-side forming surface portion is set such that the elastic body contacts the metal sheet before the ridgeline of the punch contacts the metal sheet to cause the metal sheet to undergo a plastic deformation; and when the ridgeline of the punch contacts the metal sheet, the metal sheet is supported by the elastic body between a portion where the ridgeline of the punch contacts the metal sheet and one of the ends of the metal sheet held between the die and the blank holder to cause portions of the metal sheet where the ridgeline of the punch and the elastic body contact to gradually undergo bending deformation to become a gentle shape; and when the plastic deformation is started, the metal sheet is held between the elastic body and the die.

2. The method for press forming the automotive outer panel according to claim 1, wherein the elastic body is provided in the punch via a movable device movable along a press forming direction and configured to press the elastic body toward the die to support the elastic body.

3. The method for press forming the automotive outer panel according to claim 2, wherein the elastic body contacts a portion on a side having lower tension in the press forming process among portions on both sides of the portion where the ridgeline of the punch contacts the metal sheet, the side having lower tension being a side having larger acute angle of the panel surface portion with respect to the press forming direction.

4. The method for press forming the automotive outer panel according to claim 2, wherein the elastic body contacts a portion on a side having higher tension in the press forming process among portions on both sides of the portion where the ridgeline of the punch contacts the metal sheet, the side having higher tension being a side having a smaller acute angle of the panel surface portion with respect to the press forming direction.

5. The method for press forming the automotive outer panel according to claim 1, wherein the elastic body contacts a portion on a side having lower tension in the press forming process among portions on both sides of the portion where the ridgeline of the punch contacts the metal sheet, the side having lower tension being a side having larger acute angle of the panel surface portion with respect to the press forming direction.

6. The method for press forming the automotive outer panel according to claim 1, wherein the elastic body contacts a portion on a side having higher tension in the press forming process among portions on both sides of the portion where the ridgeline of the punch contacts the metal sheet, the side having higher tension being a side having smaller acute angle of the panel surface portion with respect to the press forming direction.

7. An apparatus for press forming an automotive outer panel, the apparatus comprising:

a punch having a ridgeline;

a die having a valley line facing the punch; and a blank holder facing ends of the die, wherein the apparatus is configured to press form a metal sheet into an automotive outer panel having a character line formed by the ridgeline and the valley line and panel surface portions continuous with both sides of the character line, the punch includes punch-side forming surface portions forming the respective panel surface portions on both sides, either of the punch-side forming surface portions includes an elastic body protruding toward the die beyond one of the punch-side forming surface portions so as to abut against the metal sheet away from a portion of the metal sheet where the ridgeline of the punch contacts, the elastic body being deformed until a contact surface portion in contact with the metal sheet becomes flush with the one of the punch-side forming surface portions, the elastic body being made of a rubber material or a urethane material, and a protrusion amount of the elastic body from the one of the punch-side forming surface portions is set such that the elastic body contacts the metal sheet before the ridgeline of the punch contacts the metal sheet to cause the metal sheet to undergo a plastic deformation; and when the ridgeline of the punch contacts the metal sheet and the metal sheet is supported by the elastic body between a portion where the ridgeline of the punch contacts the metal sheet and one of the ends of the metal sheet held between the die and the blank holder to cause portions of the metal sheet where the ridgeline of the punch and the elastic body contact to gradually undergo bending deformation to become a gentle shape; and when the plastic deformation is started, the metal sheet is held between the elastic body and the die.

8. The apparatus for press forming the automotive outer panel according to claim 7, wherein the elastic body is provided in the punch via a movable device movable along a press forming direction and configured to press the elastic body toward the die to support the elastic body.

9. The apparatus for press forming the automotive outer panel according to claim 8, wherein the elastic body is provided in the one of the punch-side forming surface portions so as to contact a portion on a side having lower tension in the press forming process among portions on both sides of the portion where the ridgeline of the punch contacts the metal sheet, the side having lower tension being a side having larger acute angle of the panel surface portion with respect to the press forming direction.

10. The apparatus for press forming the automotive outer panel according to claim 8, wherein the elastic body is provided in the one of the punch-side forming surface portions so as to contact a portion on a side having higher tension in the press forming process among portions on both sides of the portion where the ridgeline of the punch contacts the metal sheet, the side having higher tension being a side having smaller acute angle of the panel surface portion with respect to the press forming direction.

11. The apparatus for press forming the automotive outer panel according to claim 7, wherein the elastic body is provided in the one of the punch-side forming surface portions so as to contact a portion on a side having lower tension in the press forming process among portions on both sides of the portion where the ridgeline of the punch contacts the metal sheet, the side having lower tension being a side having larger acute angle of the panel surface portion with respect to the press forming direction.

12. The apparatus for press forming the automotive outer panel according to claim 7, wherein the elastic body is provided in the one of the punch-side forming surface portions so as to contact a portion on a side having higher tension in the press forming process among portions on both sides of the portion where the ridgeline of the punch contacts the metal sheet, the side having higher tension being a side having smaller acute angle of the panel surface portion with respect to the press forming direction.

* * * * *